US010364538B2

(12) United States Patent
Dyke et al.

(10) Patent No.: US 10,364,538 B2
(45) Date of Patent: Jul. 30, 2019

(54) APPARATUS FOR ABSORBING ENERGY RESULTING FROM VEHICLE IMPACT

(71) Applicant: LINDSAY TRANSPORTATION SOLUTIONS, INC., Omaha, CA (US)

(72) Inventors: Gerrit A. Dyke, Stockton, CA (US); Joseph Martin Sicat, San Ramon, CA (US)

(73) Assignee: Lindsay Transportation Solutions, Inc., Rio Vista, CA (US)

( * ) Notice: Subject to any disclaimer, the term of this patent is extended or adjusted under 35 U.S.C. 154(b) by 210 days.

(21) Appl. No.: 15/654,849

(22) Filed: Jul. 20, 2017

(65) Prior Publication Data

US 2019/0024334 A1 Jan. 24, 2019

(51) Int. Cl.
*E01F 15/04* (2006.01)
*E01F 15/14* (2006.01)

(52) U.S. Cl.
CPC ..... *E01F 15/0438* (2013.01); *E01F 15/0423* (2013.01); *E01F 15/0492* (2013.01); *E01F 15/143* (2013.01)

(58) Field of Classification Search
CPC ..... E01F 15/143; E01F 15/146; E01F 15/148; E01F 15/0476; E01F 15/0423; E01F 15/0492
See application file for complete search history.

(56) References Cited

U.S. PATENT DOCUMENTS 4,928,928 A 5/1990 Buth et al.
5,078,366 A 1/1992 Sicking et al.
5,775,675 A 7/1998 Sicking et al.
6,715,735 B2 * 4/2004 Bligh ..... E01F 15/143 256/13.1
6,719,483 B1 * 4/2004 Welandsson ..... E01F 15/0476 256/13.1
7,185,882 B2 * 3/2007 Buth ..... E01F 15/143 248/66
7,694,941 B2 4/2010 Abu-Odeh et al.
8,517,349 B1 * 8/2013 Ross ..... E01F 15/143 256/1
8,905,382 B2 * 12/2014 Smith ..... E01F 15/143 256/13.1
9,714,493 B1 * 7/2017 Dyke ..... E01F 15/143
2009/0272955 A1 * 11/2009 Abu-Odeh ..... E01F 15/143 256/13.1
2009/0272956 A1 * 11/2009 Abu-Odeh ..... E01F 15/143 256/13.1
2017/0260703 A1 * 9/2017 Harman ..... E01F 15/143

FOREIGN PATENT DOCUMENTS

WO WO-2010139027 A1 * 12/2010

* cited by examiner

*Primary Examiner* — Daniel J Wiley
(74) *Attorney, Agent, or Firm* — Thomas R. Lampe

(57) ABSTRACT

Apparatus positioned at a guardrail lead end portion for absorbing energy resulting from vehicle impact includes an impact terminal, a support structure supporting the impact terminal at or adjacent to a lead end portion of the guardrail and a chute. The guardrail is in frictional engagement with inner chute surfaces and the chute applies torquing forces on the guardrail during passage of the guardrail through the chute to cause twisting of the guardrail and absorb vehicle collision impact energy.

17 Claims, 6 Drawing Sheets

APPARATUS FOR ABSORBING ENERGY RESULTING FROM VEHICLE IMPACT

TECHNICAL FIELD

This invention relates to apparatus positioned at a guardrail lead end portion for absorbing energy resulting from vehicle impact.

BACKGROUND OF THE INVENTION

It is well known to provide vehicle impact energy absorbing systems, often called "crash cushions", "crash attenuators", or "guardrail end terminals" adjacent to roadways as well as at other locations.

It is known generally to incorporate attenuators in operative association with end terminals for guardrails wherein a flattening or reshaping structure is employed at a guardrail lead end, which upon vehicle impact is movable along the guardrail to flatten or reshape the guardrail to absorb crash energy and decelerate the vehicle. The following patent documents are believed to be representative of the current state of the art in this field: U.S. Pat. No. 4,928,928, issued May 29, 1990, U.S. Pat. No. 5,078,366, issued Jan. 7, 1992, U.S. Pat. No. 8,905,382, issued Dec. 9, 2014, U.S. Pat. No. 6,719,483, issued Apr. 13, 2004, U.S. Pat. No. 5,775,675, issued Jul. 7, 1998, U.S. Pat. No. 7,185,882, issued Mar. 6, 2007, U.S. Pat. No. 8,517,349, issued Aug. 27, 2013, U.S. Pat. No. 6,715,735, issued Apr. 6, 2004 and U.S. Pat. No. 7,694,941, issued Apr. 13, 2010.

As compared to existing vehicle crash absorbing systems which employ pre-crimped pre-fed guardrail lead ends prepositioned in and passing through a housing or "chute" of a guardrail crash absorbing device, the proposed invention requires no such feature.

When utilizing the present invention, the exiting guardrail has substantially the same configuration (profile) as the initial guardrail. Thus, it is possible to revise a good portion of the guardrail after the system has been employed.

The system does not feed the rail out of the chute directly in alignment with the downstream rail.

DISCLOSURE OF INVENTION

The present invention relates to apparatus positioned at a guardrail lead end portion for absorbing energy resulting from vehicle impact. The guardrail has an elongated top edge, an elongated bottom edge spaced a predetermined substantially uniform vertical distance from said elongated top edge and opposed side surfaces extending between said elongated top edge and said elongated bottom edge.

The apparatus additionally includes an impact terminal and a support structure supporting the impact terminal at or adjacent to the guardrail lead end portion. The support structure supports a guardrail engagement structure defining an interior, a guardrail receiving opening communicating with the interior receiving the guardrail lead end portion, and a guardrail discharge opening communicating with the interior.

The support structure and the guardrail engagement structure are operable upon vehicle impact on said impact terminal to move along the guardrail and cause the guardrail to pass through said guardrail engagement structure and exit the guardrail discharge opening.

The guardrail engagement structure comprises a chute having inner chute surfaces defining the interior. The inner chute surfaces have a generally rectangular configuration along substantially the full length thereof whereby the interior has a generally rectangular cross sectional configuration along substantially the full length thereof, the chute twisted between the guardrail receiving opening and the guardrail discharge opening.

The guardrail is in frictional engagement with the inner chute surfaces, and the chute applies torquing forces on the guardrail during passage of the guardrail through the forming structure to cause twisting of said guardrail from a first guardrail orientation whereby said guardrail exits the guardrail discharge opening while maintaining substantially the same profile in a second guardrail orientation with the elongated top edge and the elongated bottom edge displaced sideways relative to one another and vehicle collision impact energy is absorbed.

Other features, advantages and objects of the present invention will become apparent with reference to the following description and accompanying drawings.

MODES FOR CARRYING OUT THE INVENTION

Figure 1:
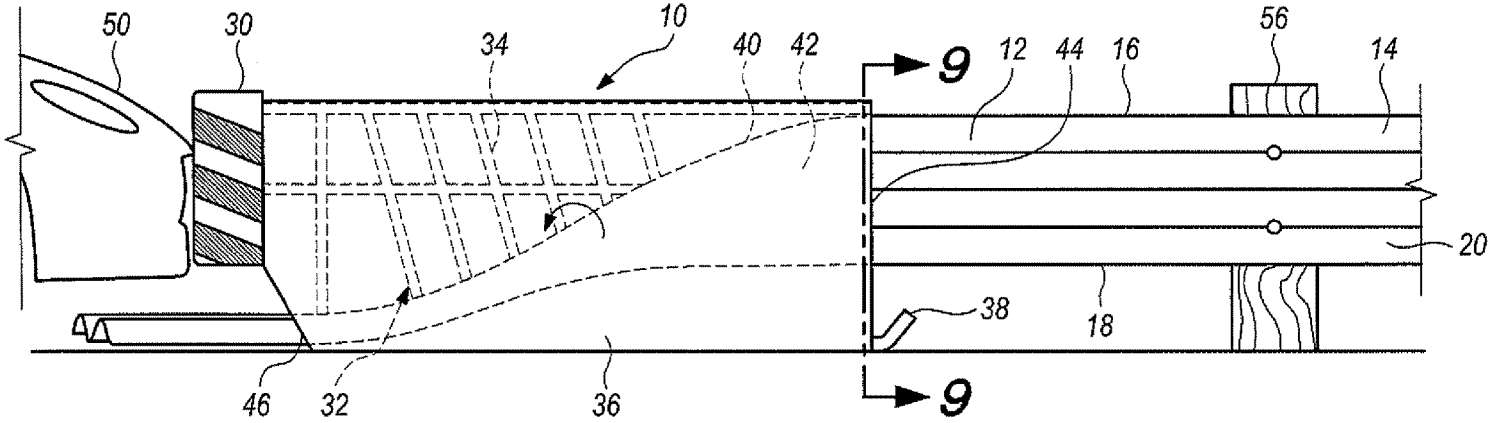
FIG. 1 is a side elevational view illustrating an embodiment of apparatus constructed in accordance with the teachings of the present invention in operative association with a guardrail just prior to front end impact by an automobile on the impact terminal of the apparatus.

Referring now to FIGS. 1-7 and 9, apparatus 10 constructed in accordance with the teachings of the present invention is illustrated. The apparatus 10 is positioned at a lead end portion 12 of a guardrail 14, which for illustrative purposes is of standard construction having a W-shaped cross section. It is to be understood however that the principles of the present invention are applicable to various profiles of guardrails, both U.S. and international.

The guardrail has an elongated top edge 16, an elongated bottom edge 18 spaced a predetermined substantially uniform vertical distance from the top edge and opposed side surfaces 20, 22 extending between the elongated top edge and the elongated bottom edge.

Apparatus 10 includes an impact terminal 30. The impact terminal is supported by a support structure 32 which in this embodiment includes a support framework 34 and a housing 36 surrounding the support framework. The apparatus support structure 32 further includes a skid 38 positioned at the end of apparatus 10 downstream of the impact terminal 30.

A guardrail engagement structure in the form of an open ended chute 40 is supported and reinforced by the support framework 34. The chute 40 defines an interior 42. A guardrail receiving opening 44 of the chute communicates with the interior and receives the guardrail lead end portion 12.

The chute also has a guardrail discharge opening 46 communicating with the interior. The discharge opening is not in alignment with the guardrail. That is, it is offset sideways and downwardly of the guardrail entering the guardrail receiving opening of the chute.

Figure 2:
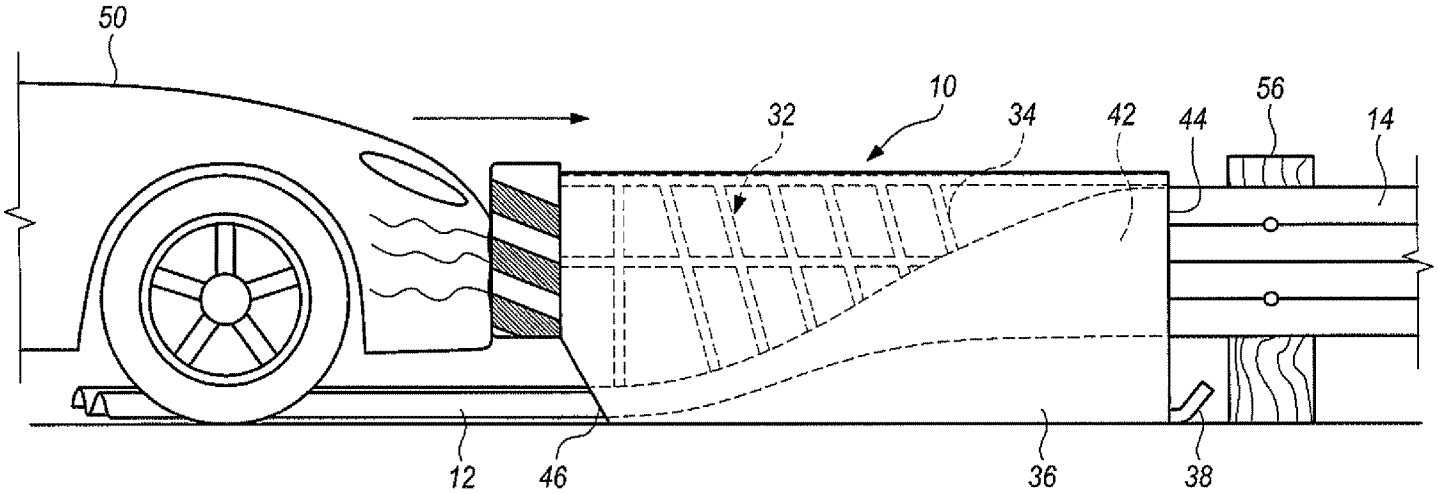
FIG. 2 is a view similar to FIG. 1, but illustrating the condition of the apparatus relative to the guardrail after the vehicle has crashed and moved the apparatus in the direction of the arrow.
Figure 3:
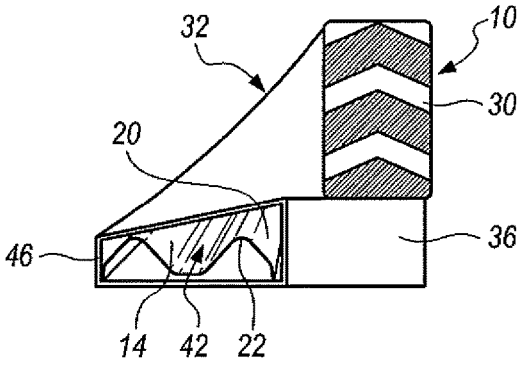
FIG. 3 is an elevational frontal view of the apparatus with a guardrail lead end portion, shown in cross section, exiting a guardrail discharge opening of the chute of the apparatus.

The support structure 12 and the chute are operable upon vehicle impact on the impact terminal 30 to move along the guardrail and cause the guardrail to pass through the chute and exit the guardrail discharge opening 46. FIG. 1 shows the relative positioning of the apparatus 10 and the guardrail at the time impact on the impact terminal by an automobile 50 takes place. FIG. 2 illustrates the relative positioning of the guardrail and the apparatus 10 showing movement of the apparatus 10 downstream in the direction of the arrow further along guardrail 14 responsive to the crash.

Figure 4:
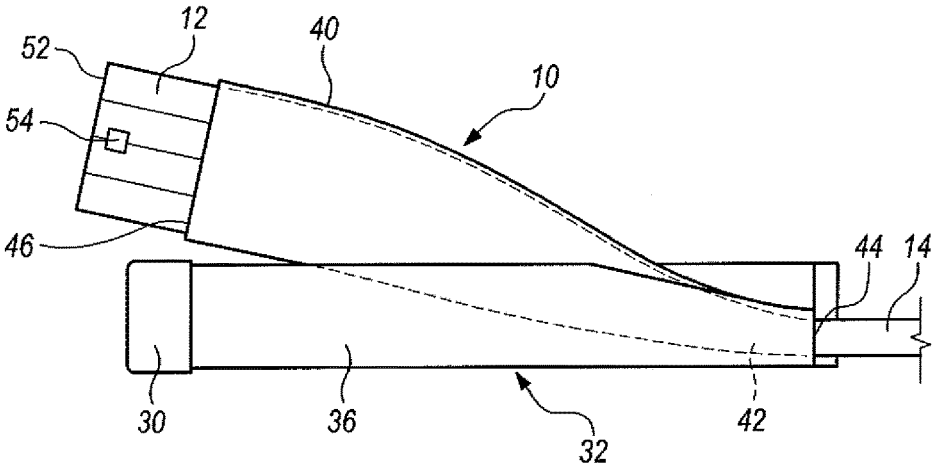
FIG. 4 is a top, plan view of the apparatus and guardrail lead end portion prior to vehicle impact.
Figure 5:
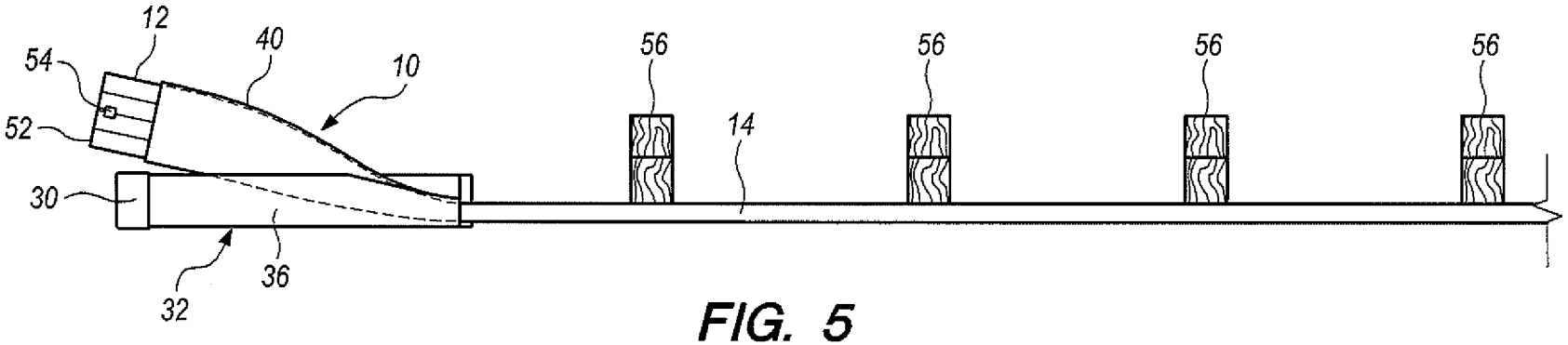
FIG. 5 is a top, plan view of the apparatus and an associated post supported guardrail.
Figure 6:
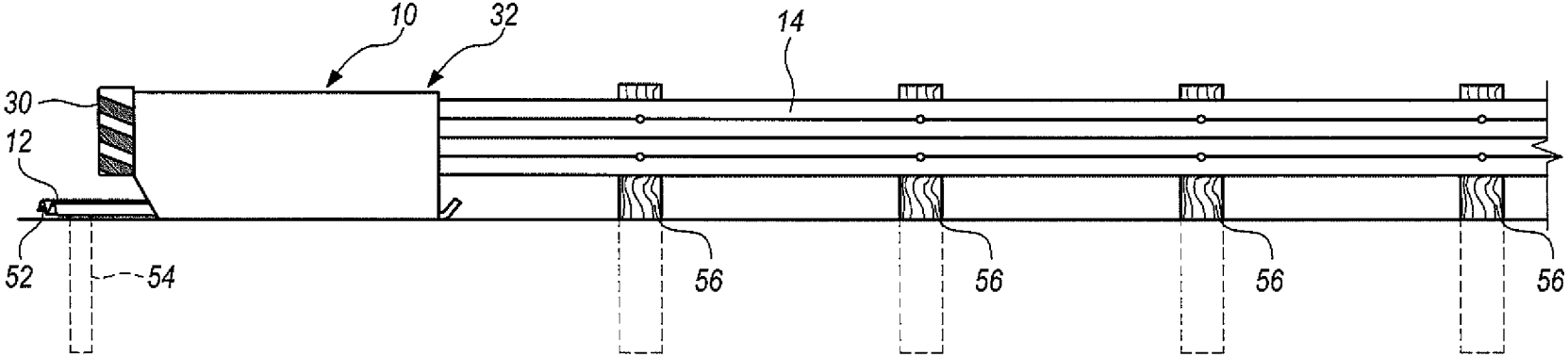
FIG. 6 is a side elevational view of the apparatus, guardrail and posts as shown in FIG. 5.
Figure 7:
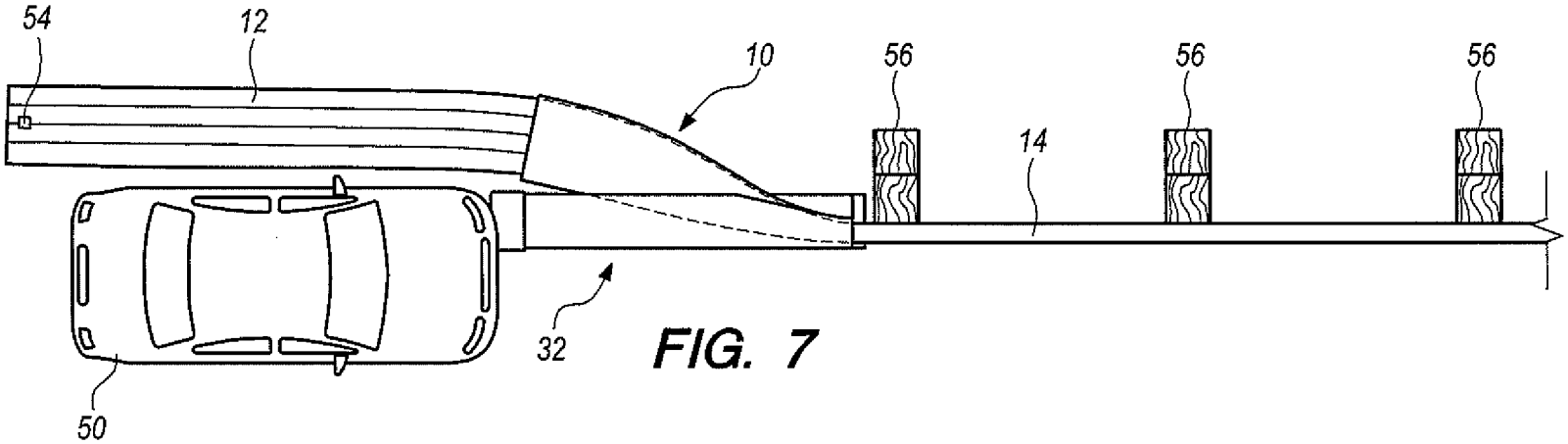
FIG. 7 is a top, plan view similar to FIG. 5, but illustrating the condition of the apparatus and guardrail after an automobile has crashed into the apparatus and moved the apparatus along the guardrail.

In the embodiment under discussion, and as shown in FIGS. 4, 6 and 7, the lead end portion 12 of the apparatus 10 has an upstream end 52 anchored to the ground by an anchor post 54 or other suitable anchor structure, the lead end portion 12 extending through the chute and anchored when the apparatus 10 is installed at the guardrail. It is to be noted that the lead end portion 12 between the anchor structure and the discharge opening has a horizontal orientation and is flat on the ground.

Chute 40 has inner chute surfaces defining interior 42. The combined inner chute surfaces have a generally rectangular configuration along substantially the full length of the chute; that is, the interior has a generally cross sectional configuration along substantially the full length thereof.

The chute 40 is twisted 90 degrees between the guardrail receiving opening and the guardrail discharge opening, the guardrail 14 being in frictional engagement with the inner chute surfaces and the chute applying torquing forces on the guardrail 14 during passage of the guardrail through the chute to cause twisting of the guardrail from a first guardrail orientation, i.e. the vertical orientation shown in the drawing figures and as supported by posts 56 to a second orientation of the guardrail while maintaining substantially the same profile as it exits the guardrail discharge opening. In this second guardrail orientation, the elongated top edge 16 and the elongated bottom edge 18 are displaced sideways relative to one another and vehicle collision impact energy is absorbed.

More particularly, the inner surfaces of the chute are configured to twist the guardrail 14 substantially 90 degrees to the second orientation wherein the opposed side surfaces of the guardrail are substantially horizontally disposed when exiting guardrail discharge opening 46.

The chute 40 inclines downwardly from the guardrail receiving opening to the guardrail discharge opening and the discharge opening is disposed at or closely adjacent to and above ground level.

The impact terminal 30 and the guardrail receiving opening 44 are substantially in alignment with the post mounted guardrail 14 downstream from the chute.

The chute 40 extends laterally sideways between the guardrail receiving opening and the guardrail discharge opening whereby the discharge opening is disposed laterally relative to the impact terminal 30 and is out of alignment with the guardrail 14 downstream from the chute as supported by the support posts.

In this embodiment the chute 40 is oriented to direct the guardrail passing therethrough upon vehicle impact to a position on the ground wherein the guardrail after exit thereof from the discharge opening is substantially parallel to but not in alignment with the path of movement of the impact terminal during vehicle impact.

Figure 8:
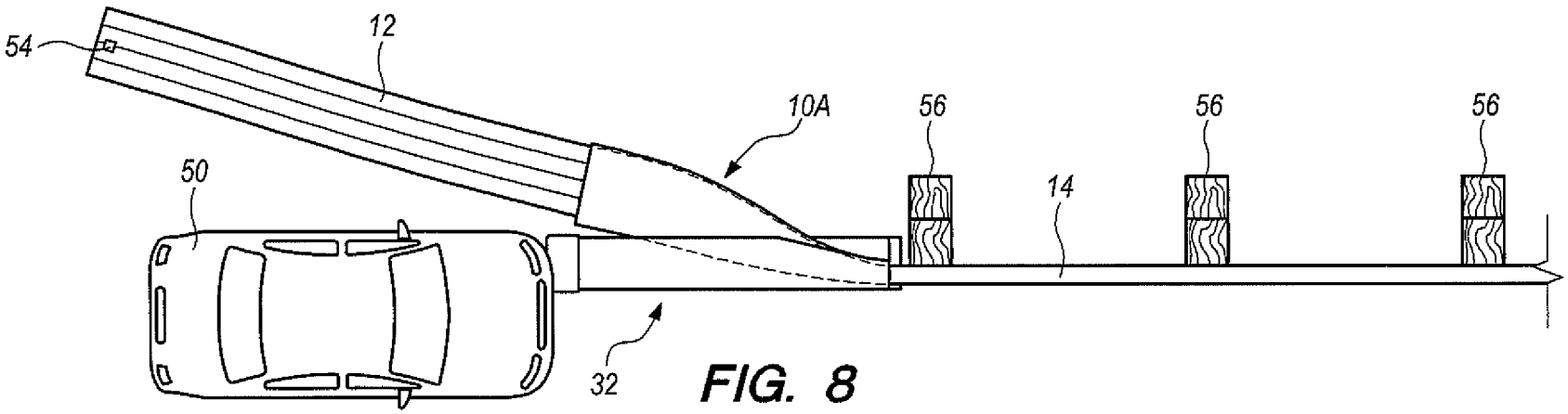
FIG. 8 is a view similar to FIG. 7, but showing an alternative embodiment wherein the guardrail exits the apparatus in a direction lateral to the direction of impact.
Figure 9:
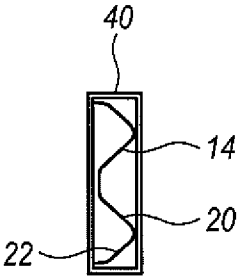
FIG. 9 is a cross sectional view taken along line 9-9 in FIG. 1.

FIG. 8 shows an alternative embodiment wherein the apparatus 10A and the function of apparatus 10A are the same as apparatus 10 and its function, with one exception. In this embodiment the chute is oriented to direct the guardrail passing therethrough upon vehicle impact to a position on the ground wherein the guardrail after exit from the discharge opening is angled laterally outwardly away from the path of movement of the impact terminal 30 during vehicle impact.

Figure 10:
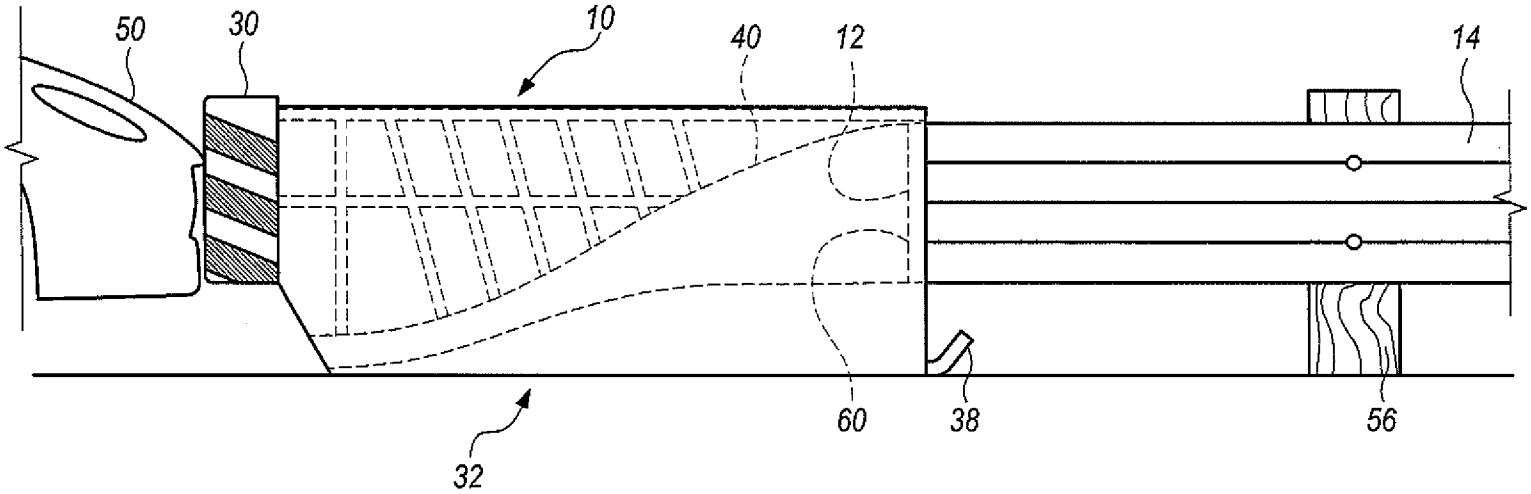
FIG. 10 is a view similar to FIG. 1 showing another alternative operative arrangement between apparatus and guardrail.

FIG. 10 illustrates another arrangement wherein the apparatus 10, as installed and prior to movement by a vehicle impact receives only a distal end 60 of the lead end portion of guardrail 14. That is, the lead end portion of the guardrail initially does not extend all the way through the apparatus. With this arrangement, the guardrail is entirely in its initial normal vertical orientation as employed as a guardrail and only becomes twisted 90 degrees and exits the guardrail discharge opening 46 when vehicle impact drives the apparatus 10 a length slightly less than the length of the chute.

Figure 11:
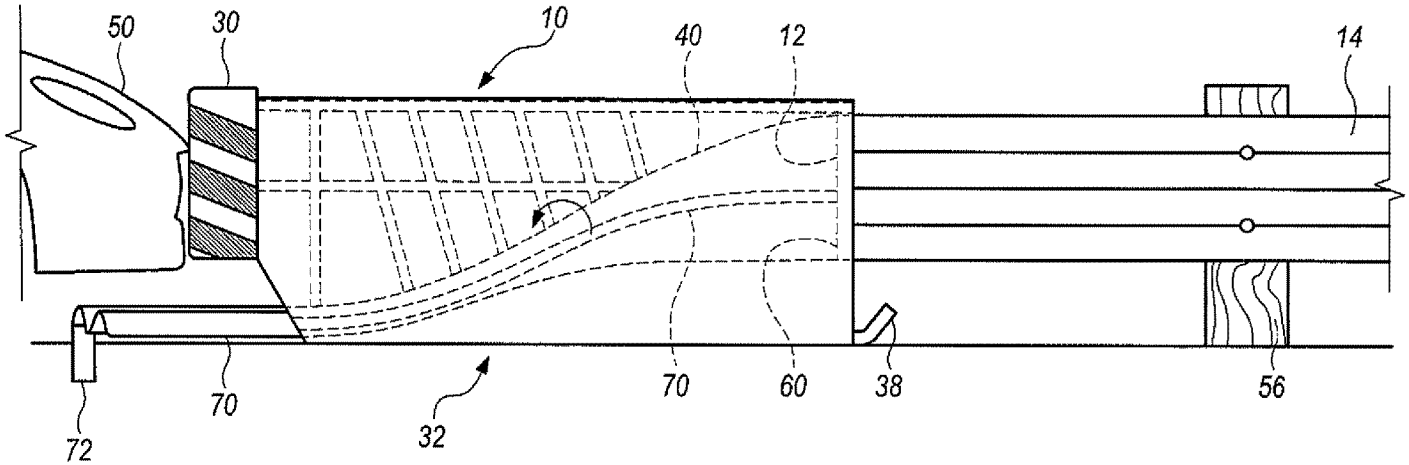
FIG. 11 is an alternative embodiment of the invention similar to the embodiment of FIG. 10, but employing an anchor and tension strap.

FIG. 11 shows an arrangement similar to that of FIG. 10, like structural elements identified by the same reference numerals. In this embodiment a tension structure (for example a tension strap 72) is attached to the distal end 60 of the lead end portion of the guardrail. The other end of the tension structure is attached to an anchor 72. Upon vehicle impact the tension structure will pull the guardrail through the chute as the chute is displaced downstream along the guardrail.

Figure 12:
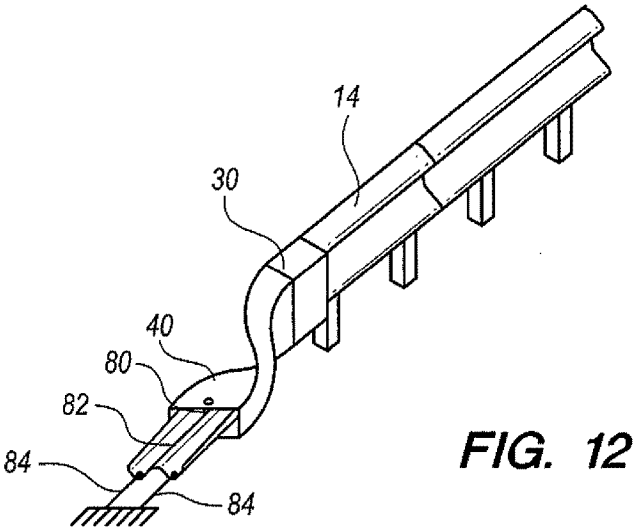
FIG. 12 is a perspective view illustrating an arrangement similar to FIG. 11, but employing a cutting tooth at the exit end of the chute.

FIG. 12 illustrates an embodiment of the invention wherein a cutting tooth 80 is attached to the chute 40 to slice the guardrail 14 as the chute moves relative to the guardrail upon vehicle impact on the impact terminal 30 (only a portion of which is shown in this figure). The lead end portion of the guardrail projects from the chute discharge opening and is anchored to the ground, a longitudinal cut or slit made by the cutting tooth 80 identified by reference numeral 82. A tension structure in the form of cables 84 anchor the cut side guardrail portions.

Use of the cutting tooth minimizes shard interaction with the guardrail going through the chute assembly and reduces heat, sparks, etc. from under the impacting vehicle.

The invention claimed is:

1. Apparatus positioned at a guardrail lead end portion for absorbing energy resulting from vehicle impact, said guardrail having an elongated top edge, an elongated bottom edge spaced a predetermined substantially uniform vertical distance from said top edge and opposed side surfaces extending between said elongated top edge and said elongated bottom edge, said apparatus comprising:

an impact terminal;

a support structure supporting said impact terminal at or adjacent to the guardrail lead end portion, said support structure extending from said impact terminal;

a guardrail engagement structure supported by said support structure, said guardrail engagement structure defining an interior, a guardrail receiving opening communicating with said interior receiving the guardrail lead end portion, and a guardrail discharge opening communicating with said interior, said support structure and said guardrail engagement structure operable upon vehicle impact on said impact terminal to move along said guardrail and cause said guardrail to pass through said guardrail engagement structure and exit said guardrail discharge opening, the guardrail engagement structure comprising a chute having inner chute surfaces defining said interior, said inner chute surfaces having a generally rectangular configuration along substantially the full length thereof whereby said interior has a generally rectangular cross sectional configuration along substantially the full length thereof, said chute twisted between said guardrail receiving opening and said guardrail discharge opening, said guardrail being in frictional engagement with said inner chute surfaces, and said chute applying torquing forces on said guardrail during passage of said guardrail through said guardrail engagement structure to cause twisting of said guardrail from a first guardrail orientation whereby said guardrail exits said guardrail discharge opening in a second guardrail orientation with said elongated top edge and said elongated bottom edge displaced sideways relative to one another and vehicle collision impact energy is absorbed.

2. The apparatus according to claim 1 wherein said inner chute surfaces are configured to twist said guardrail substantially 90 degrees to said second orientation wherein said opposed side surfaces of said guardrail are substantially horizontally disposed while maintaining the same profile when exiting said guardrail discharge opening.

3. The apparatus according to claim 2 wherein said chute inclines downwardly from said guardrail receiving opening to said guardrail discharge opening and said discharge opening is disposed at or closely adjacent to and above ground level.

4. The apparatus according to claim 3 wherein said impact terminal and said guardrail receiving opening are substantially in alignment with said guardrail downstream from said chute.

5. The apparatus according to claim 4 wherein said chute extends laterally sideways between said guardrail receiving opening and said guardrail discharge opening whereby said discharge opening is disposed laterally relative to said impact terminal and is out of alignment with said guardrail downstream from said chute.

6. The apparatus according to claim 5 wherein said chute is oriented to direct the guardrail passing therethrough upon vehicle impact to a position on the ground wherein the guardrail after exit thereof from said discharge opening is substantially parallel to the path of movement of the impact terminal during vehicle impact.

7. The apparatus according to claim 5 wherein said chute is oriented to direct the guardrail passing therethrough upon vehicle impact to a position on the ground wherein the guardrail after exit thereof from said discharge opening is angled laterally outwardly away from the path of movement of the impact terminal during vehicle impact.

8. The apparatus according to claim 1 wherein said lead end portion has an upstream end anchored to the ground by an anchor structure, said lead end portion extending through the chute prior to vehicle impact.

9. The apparatus according to claim 8 wherein said lead end portion between said anchor structure and said discharge opening is in said second orientation.

10. The apparatus according to claim 1 wherein said inner chute surfaces are surfaces of attached chute walls.

11. The apparatus according to claim 1 wherein said guardrail lead end portion has a distal end located at or closely adjacent to the guardrail receiving opening.

12. The apparatus according to claim 11 additionally comprising a tension structure and a tension structure anchor, said tension structure secured to said distal end and said tension structure anchor.

13. The apparatus according to claim 12 wherein said tension structure anchor is disposed outside said forming structure interior and spaced from said chute.

14. The apparatus according to claim 1 wherein said guardrail lead end portion has a distal end located within the interior of said forming structure.

15. The apparatus according to claim 14 additionally comprising a tension structure and a tension structure anchor, said tension structure secured to said distal end and said tension strap anchor.

16. The apparatus according to claim 15 wherein said tension structure anchor is disposed outside said forming structure interior and spaced from said chute.

17. The apparatus according to claim 1 additionally comprising a cutting tooth attached to said chute for cutting said guardrail at or closely adjacent to said guardrail discharge opening.

* * * * *